United States Patent [19]

Müller

[11] Patent Number: 4,587,790

[45] Date of Patent: May 13, 1986

[54] APPARATUS FOR THE STORAGE OF FLAT PRODUCTS ARRIVING IN AN IMBRICATED FORMATION, ESPECIALLY PRINTED PRODUCTS

[75] Inventor: Erwin Müller, Dürnten, Switzerland

[73] Assignee: Ferag AG, Hinwil, Switzerland

[21] Appl. No.: 432,557

[22] Filed: Oct. 4, 1982

[30] Foreign Application Priority Data

Oct. 12, 1981 [CH] Switzerland ..... 6503/81

[51] Int. Cl.[4] ..... B65B 63/04

[52] U.S. Cl. ..... 53/118; 242/59

[58] Field of Search ..... 53/118, 119, 116, 117, 53/430; 242/59, 65, 74

[56] References Cited

U.S. PATENT DOCUMENTS

| | | | |
|---|---|---|---|
| 3,606,723 | 9/1971 | Clark | 53/450 X |
| 4,063,693 | 12/1977 | Achelpohl et al. | 53/118 X |
| 4,438,618 | 3/1984 | Honegger | 53/118 X |

FOREIGN PATENT DOCUMENTS

| | | | |
|---|---|---|---|
| 153740 | 7/1952 | Australia | 53/118 |
| 574299 | 4/1959 | Canada | 53/118 |
| 0054735 | 6/1982 | European Pat. Off. | 53/118 |
| 2092557 | 2/1981 | United Kingdom | 242/59 |

*Primary Examiner*—James F. Coan

*Attorney, Agent, or Firm*—Werner W. Kleeman

[57] ABSTRACT

At a moveable frame there is rotatably mounted a driveable winding core. The one end of a tension-resistant winding band is connected with this winding core, and such winding band is wound-up upon a band spool. This band spool is rotatably mounted in arm members of the frame. Acting upon the shaft of the winding core is a jaw brake. The shaft of the band spool is likewise brakeable and blockable by means of a jaw brake. The frame together with the winding core, band spool and the therebetween traveling winding band can be transported. For winding-up flat products or the like the shaft of the winding core is driven, and the jaw brake effective upon such shaft is opened or retracted. The band spool is slightly braked by the jaw brake associated with the shaft of the band spool. The flat products are infed to a winding gap and together with the winding band which is under tension wound-up upon the winding core. After formation of the wound product package the winding core and the band spool are blocked by means of their related jaw brakes. The package is held together by the winding band which is retained under tension.

18 Claims, 6 Drawing Figures

Fig.5
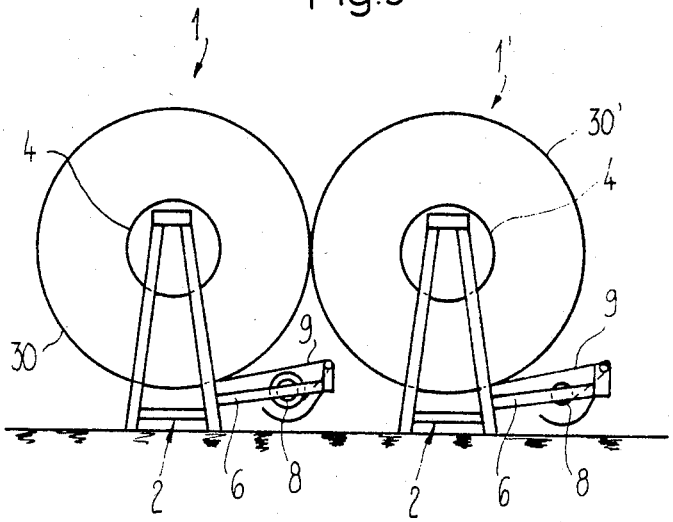
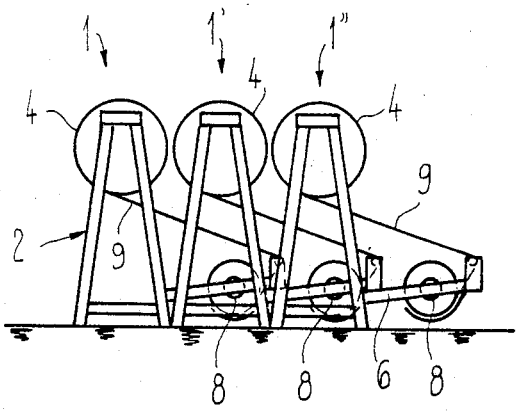
Fig.6

APPARATUS FOR THE STORAGE OF FLAT PRODUCTS ARRIVING IN AN IMBRICATED FORMATION, ESPECIALLY PRINTED PRODUCTS

CROSS REFERENCE TO RELATED APPLICATIONS

This application is related to the commonly assigned, co-pending U.S. application Ser. No. 06/338,568, filed Jan. 11, 1982, entitled "Method and Apparatus for the Long-term Pressing of Printed Products, Especially Newspapers", since granted as U.S. Pat. No. 4,494,359 on Jan. 22, 1985, and the commonly assigned, co-pending U.S. application Ser. No. 412,843, filed Aug. 30, 1982, entitled "Winding Body for Winding-up Continuously Arriving Flat Structures, Especially Printed Products Arriving in an Imbricated Product Formation."

BACKGROUND OF THE INVENTION

The present invention relates to a new and improved construction of apparatus for the storage of flat products, especially printed products, arriving in an imbricated product formation.

Generally speaking, the storage apparatus of the present development is of the type which comprises a rotatably mounted and driveable winding core to which there are infed from below the products, and at least one rotatable supply spool mounted forwardly of the winding core with regard to the conveying or feed direction of the products which are to be wound-up. The supply spool serves for supplying a separation or partition band which travels beneath the path of travel of the products. The separation band is connected at one end with the winding core and, during the winding-up of the products, travels from below onto the winding core and due to a braking action is held under a tensional stress or tension.

With one such type of apparatus as is known from the German Patent Publication No. 2,544,135, a winding core is rotatably and detachably mounted in a stationary frame. This winding core and the wound package formed thereon, as the case may be, has wrapped about a portion of its circumference pressure bands or tapes which are further guided at a rocker member or balance bearing tangentially at the wound package. By means of this rocker member or balance the products arriving in an imbricated product formation are infed from below to the winding core. The winding-up of the infed products upon the winding core is accomplished by rotating the same or the package, respectively, due to the frictional contact of the pressure bands at the circumference of the wound package. In order to render possible an accomodation of the pressure bands to the varying diameter of the wound package it is necessary to provide complicated guide means for such pressure bands.

Between the wound layers or plies of the package there is wound a separation or partition band which is withdrawn from a supply roll arranged beneath the product stream and forwardly of the winding core in the stationary frame, viewed with respect to the conveying direction of the products. The separation band which is inputted to the winding core is braked by a pair of rolls.

If all of the products have been wound-up upon the winding core, then the separation band is wrapped twice while empty around the wound package and then is secured manually by means of adhesive tapes at the wound package. Finally, the separation band is severed behind the adhesive bonding location. The wound package is then exchanged for a new, empty winding core, by means of which there now must be manually connected the free end of the separation band which arrives from the supply roll.

In order to remove the stored products out of the wound package such is mounted in a stationary frame. The end of the separation band, prior to the start of the unwinding operation, must be manually connected with a driveable wind-up spool which is fixedly arranged in the frame. By means of conveyor bands bearing at the circumference of the wound package the latter is placed into rotation while being braked. Such type of wind-off or unwinding station has been disclosed, for instance, in German Pat. No. 2,526,432.

The described cutting-through or severing of the separation band at the end of the winding operation and the manual connection of the separation band with a new winding core and with the wind-up spool during the unwinding operation is extremely time-consuming and precludes the automation of the winding-up and winding-off operations.

The severing of the separation band, after fabrication of a wound package, then can lead to difficulties if, following the winding-off of the products from the winding core, the separation or winding band must be used for the formation of a new package. If this new package requires a greater length of the separation or winding band because of a larger package diameter or because of a reduced thickness of the products which are to be wound-up, then there is necessitated a time-consuming attachment of further band sections.

SUMMARY OF THE INVENTION

Therefore, with the foregoing in mind it is a primary object of the present invention to provide a new and improved construction of apparatus for the storage of flat products, especially printed products, arriving in an imbricated product formation, which is not afflicted with the aforementioned drawbacks and limitations of the prior art constructions heretofore discussed.

Another and more specific object of the present invention aims at providing a constructionally simple apparatus of the previously mentioned type which allows for a rapid preparation or setting-up of the apparatus for the winding-up of products upon the winding core or the winding-off of the products from such winding core, and furthermore, enables winding products of any random type, and specifically, also those having a certain thickness and a certain stiffness, into a tight package within which the products retain their mutual position even during handling thereof, such as during transporting thereof.

Still a further significant object of the present invention is directed to a new and improved construction of apparatus for the storage of substantially flat products, especially printed products, arriving in an imbricated product formation, which storage apparatus is relatively simple in construction and design, relatively economical to manufacture, extremely reliable in operation, not readily subject to breakdown or malfunction, and requires a minimum of maintenance and servicing.

Now in order to implement these and still further objects of the invention, which will become more readily apparent as the description proceeds, the apparatus for the storage of flat products arriving in an imbricated product formation, especially printed products, as contemplated by the present development is manifested by the features that both the winding core and also the supply spool are mounted in a common mobile frame or frame unit and provided with a coupling arrangement for the selective coupling of a drive. The winding core can be braked in the winding-off rotational direction and can be blocked by means of a blocking device which is effective in the winding-off rotational direction and arranged in the frame.

Since the winding core and the supply spool are housed in a common mobile frame or frame unit and continuously remain in such frame, the separation band always can remain connected with the winding core and the supply spool. Thus, there are not required any manual operations either before the winding-up operation or before the winding-off operation, in order to connect the separation or partition band with the winding core or the supply spool. By blocking the winding core and the supply spool the separation band which is wound-up under tension is retained in a tensioned state. A loosening or slackening of the wound package, specifically also during transport of the apparatus, can be effectively avoided in this manner, without having to wrap the separation or partition band a number of times about the finished or wound package and without having to employ for this purpose further additional measures or facilities.

The preparation or setting-up of the apparatus can be accomplished extremely rapidly, since prior to the start of the winding-up operation or winding-off operation, respectively, it is only necessary to connect with a suitable drive the winding core or the supply spool, respectively, by means of the corresponding coupling arrangement, and there must be released the blocking of the winding core and the supply spool. Under circumstances, there is further required a coupling of the winding core or the supply spool, as the case may be, with a brake arrangement, in the event that the latter is not arranged at the frame, rather at the winding station or unwinding station, as the case may be.

In German Pat. No. 1,244,656 there is disclosed an apparatus for the storage of veneer sheets arriving at a mutual spacing from one another, these veneer sheets being wound-up in conjunction with a separation band upon a winding drum. This winding drum, together with a supply spool for the separation band, is mounted in a mobile frame. The separation band is placed over the veneer sheets at a region located forwardly of the winding gap, the veneer sheets being supported at their underside by a pressure band which wraps about the winding drum almost over the entire circumference thereof. The wound package is retained together by such pressure band, whereas the separation band only has assigned thereto the task of maintaining the wound layers or plies separated from one another. It is for this reason that the separation band is fabricated of a low-grade material, and therefore, after empyting the winding drum is no longer used and must be thrown away. The separation band therefore cannot be repeatedly used for the formation of different packages. As a result, prior to the formation of a new package there must be inserted each time a new separation band, the end of which must be connected manually in a time-consuming fashion with the winding drum.

This heretofore known solution is not only complex in its handling or manipulations, but also is of exceedingly complicated construction. On the one hand, the pressure band must always be sufficiently tensioned and, on the other hand, must be capable of following the package diameter which increases during the winding-up of the veneer sheets, requiring a complicated guiding of the pressure band.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 5 illustrates two apparatuses of the type shown in FIG. 1 containing stored printed products and arranged in an intermediate storage; and FIG. 6 illustrates adjacently stored empty apparatuses of the type shown in FIG. 1.

DETAILED DESCRIPTION OF THE PREFERRED EMBODIMENTS

Figure 1:
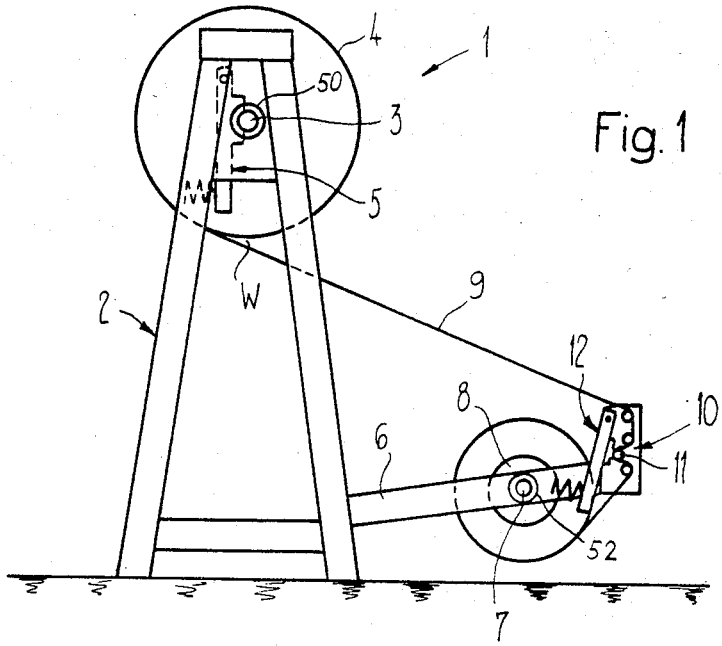
FIG. 1 illustrates a first embodiment of an apparatus for winding-up and storing printed products.
Figure 2:
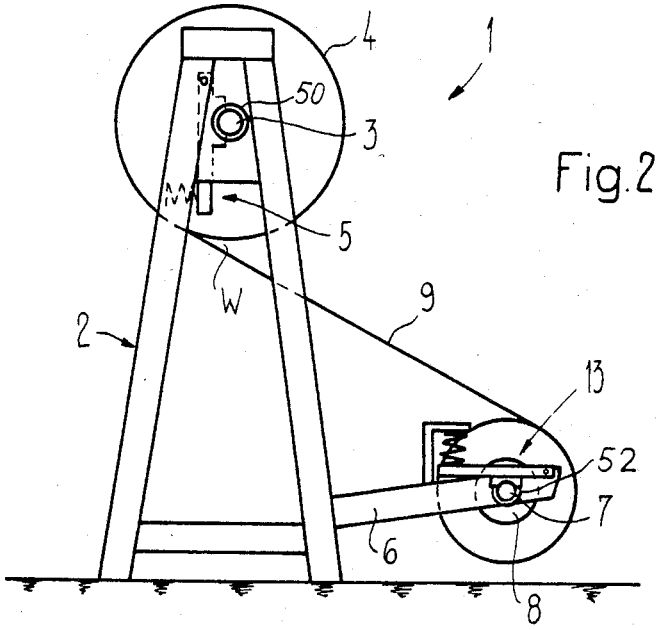
FIG. 2 illustrates a further construction of apparatus for winding-up and storing printed products.

Describing now the drawings, in FIGS. 1 and 2 there are illustrated two exemplary embodiments of a winding-up and storage apparatus 1, which, however, only slightly differ from another. Each winding-up and storage apparatus or device 1 contains a mobile frame or frame unit 2 in the form of a bearing block or pedestal or equivalent structure. In the frame 2 there is rotatably mounted a shaft 3 of a substantially cylindrical winding core 4. Engaging at the shaft 3 is a merely schematically illustrated jaw or friction brake 5 possessing a regulatable braking force, the brake venting mechanism of which has not been particularly shown. Connected with the shaft 3 are the here merely schematically depicted coupling means 50 which are of known construction and serve to operatively couple the shaft 3 with a suitable drive or drive means, such as the drive structure 24 and 18 of the arrangement of FIG. 3 as will be explained more fully hereinafter.

Furthermore, the frame 2 possesses two substantially mutually parallel arms or arm members 6 extending in spaced relationship from one another, wherein in the illustration of FIGS. 1 and 2 only one of the arm members 6 is visible. Rotatably mounted at such arm members 6 is a shaft 7 of a band spool 8. Just as was the case for the shaft 3 of the winding core 4 there are also connected conventional and thus merely schematically indicated coupling means 52 with the shaft 7 and which coupling means 52 allow for coupling thereto a suitable drive or drive means, such as the drive structure 18, 28 and 29 of the arrangement of FIG. 4 and as also will be more fully explained hereinafter. Wound upon the band spool 8 is a winding band or tape 9 which consists of a tension-resistant material, for instance, any suitable plastics material. As has been illustrated in FIGS. 1 and 2, this winding band 9 is fixedly connected at its one end with the winding core 4. With the exemplary embodiment depicted in FIG. 1 the winding band 9 which is paid-off of the band spool 8 is guided over a number of guide rolls 10, whereas with the construction of apparatus depicted in FIG. 2 the winding band 9 travels directly from the band spool 8 to the winding core 4.

As illustrated in the arrangement of FIG. 1, there is provided a jaw or friction brake 12 possessing a regulatable braking force, which either acts upon the guide roll designated by reference character 11 or upon the winding band 9 traveling over such guide roll 11. With the somewhat modified exemplary embodiment depicted in FIG. 2 there is likewise provided a jaw or friction brake 13 possessing a regulatable braking force, which, however, acts upon the shaft 7 of the band spool 8. The venting mechanism of the jaw brakes 12 and 13 or equivalent brake structure have not been particularly depicted in the showing of FIGS. 1 and 2 in order to simplify the illustration thereof. Both of the jaw brakes 12 and 13 serve the same purpose, namely, to respectively brake or block the winding band 9, as the same will be more fully explained in the description to follow.

Figure 3:
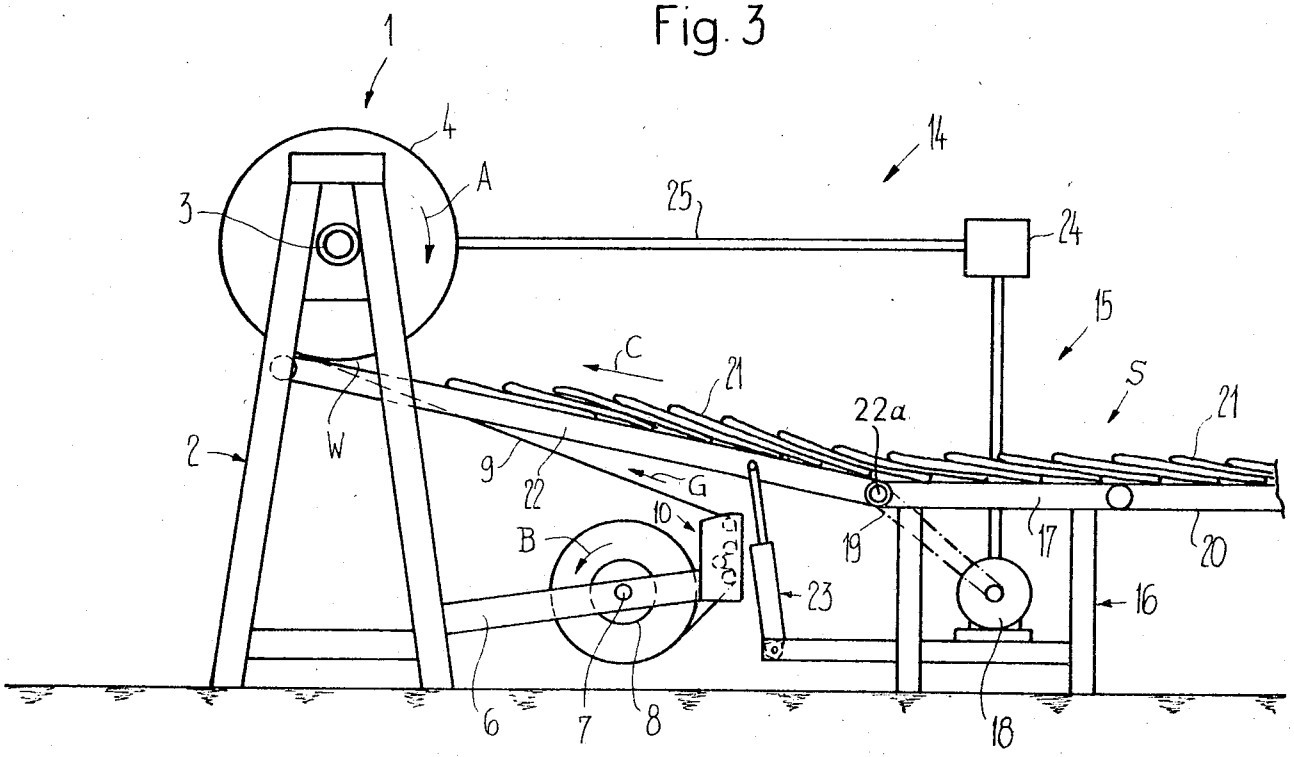
FIG. 3 illustrates a winding-up or winding station equipped with an apparatus of the type depicted in FIG. 1.

In FIG. 3 there has been schematically illustrated a winding or winding-up station 14 where the winding-up and storage device 1 is arranged after a product delivery apparatus or device 15. This product delivery or infeed apparatus 15 comprises a frame 16 at which there is mounted a belt or band conveyor 17. Furthermore, there is secured the drive motor 18 at the frame 16, this drive motor 18 driving by means of the only schematically illustrated drive connection 19 the band conveyor 17. Arranged forwardly or upstream of the band conveyor 17 is a further band or belt conveyor 20 which delivers to the winding-up station 14 the printed products 21 which are to be wound-up, and which printed products 21 arrive in an imbricated product formation S. At the band conveyor 17 there merges a rocker or balance member 22 in which there is arranged a band or belt conveyor driven by the drive motor 18. The rocker member 22 is pivotable about a pivot shaft **22*a* and is connected with a contact or pressing mechanism 23 secured to the frame or frame unit 16. This contact or pressing mechanism 23 contains a spring storage and presses the rocker member 22 against the winding core 4 and the package forming upon such winding core 4**.

The drive motor 18 drives a merely schematically illustrated bevel or angular gearing 24 or equivalent structure, which is releasably coupled by means of a not here further illustrated but appropriate drive connection 25 with the shaft 3 of the winding core 4. As to the jaw or friction brakes 5 and 12 which have not been particularly shown in FIG. 3, the friction brake 5 is completely vented, whereas the friction brake 12 (or in the case of the variant embodiment of FIG. 2 the friction brake 13) is effective in order to somewhat brake the winding band 9.

The empty winding-up and storage device 1 is only connected by means of the drive connection 25 with the delivery or infeed apparatus 15. The device 1 therefore can be brought by means of conventional transport means, for instance a fork-lift truck or the like, from a storage to the winding-up station 14 and can be connected with the rocker member 22 in the manner depicted in FIG. 3. Thereafter, by means of the coupling means 50 provided at the shaft 3 the latter is coupled with the bevel gearing 24 or equivalent gearing structure.

By means of the drive motor 18 the shaft 3 is now placed into rotation in the direction of the arrow A along with the winding core 4. This results in a withdrawal of the winding band 9 from the band spool 8, which is placed into rotation in the direction of the arrow B. By virtue of the action of the jaw brake 12 or the jaw brake 13, as the case may be, the braking force of which can be regulated as a function of the increasing diameter of the package, the winding band or tape 9 traveling onto the winding core 4 experiences an essentially constant tension. The imbricated product stream S which is inputted from below in the direction of the arrow C to the winding core 4 is wound-up upon such winding core 4, and the co-wound winding band 9 acts as a separation or partition layer between the wound layers or plies. A detailed explanation of this winding-up operation has been given in the commonly assigned, co-pending U.S. application Ser. No. 06/280,998, filed July 6, 1981, since granted as U.S. Pat. No. 4,438,618, on Mar. 27, 1984, and the cognate German Patent Publication No. 3,123,888 and the cognate British Patent Publication No. 2,081,230.

The winding band 9 arranged beneath the path of travel of the imbricated product formation S and traveling in the conveying direction C of such imbricated product formation or product stream S forms, in conjunction with the winding core 4 or the package forming thereon, a winding gap W. Since the winding band 9, as mentioned, travels onto the winding core 4 while under tension, the printed products 21 which arrive at such winding gap W experience a compression or pressing action. This pressing action of the printed products 21 contributes to the formation of a tightly wound package, which also is snugly retained together during the transport.

After completion of the winding-up operation the shaft 3 of the winding core 4 is blocked by means of the jaw or friction brake 5, whereas by means of the jaw or friction brake 12 there is blocked the winding band 9, or by means of the jaw or friction brake 13 the winding spool 8 is blocked. Due to this blocking action there is avoided that after decoupling of the shaft 3 from the bevel gearing 24 the winding band 9 which is still under tension can cause rotation of the winding core 4 and the band spool 8, which would lead to a loosening of the wound product package upon the winding core 4. Since the finished wound package is retained together by the winding band 9 which is under tension, it is not necessary, following the formation of the wound package, to still wrap a number of wraps or layers of the winding band about the package.

The winding-up and storage device 1 can be now transported, in conjunction with the printed products 21 wound-up upon the winding core 4, from the winding-up station 14 to an intermediate storage. Consequently, the winding-up station 14 is available for the formation of the next printed product package.

Figure 4:
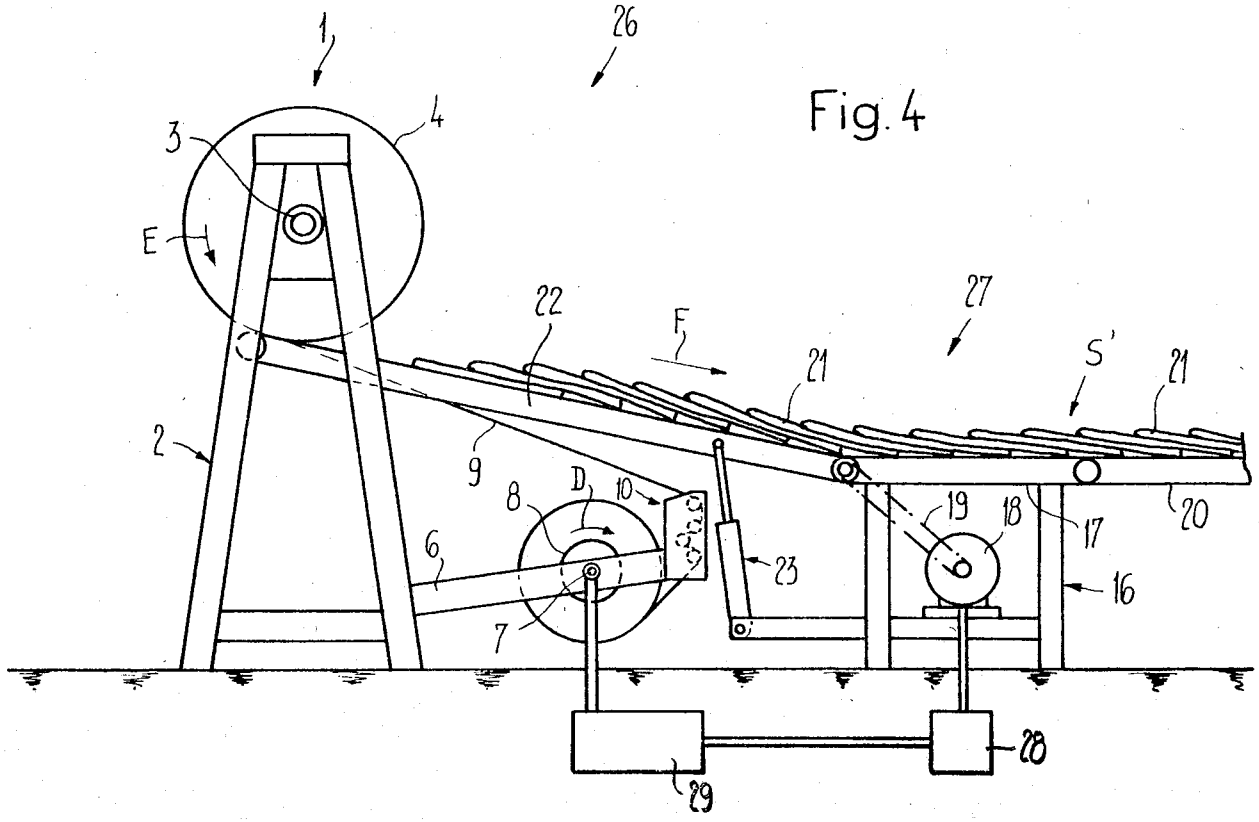
FIG. 4 illustrates a winding-off or unwinding station for the removal of the printed products stored in an apparatus of the type depicted in FIG. 1.

In FIG. 4 there has been depicted a winding-off or unwinding station 26 which is similar to the winding-up or winding station 14 of the arrangement of FIG. 3. It is for this reason that in FIGS. 3 and 4 there have been generally used the same reference characters to denote the same or analogous components. It should be understood, however, that the winding-up station 14 and winding-off station 26 can be spatially separated from one another and can differ from one another as to their construction or design.

As particularly evident by inspecting FIG. 4, there is connected to the product removal device 27 a winding and storage device 1 containing a wound printed product package. The shaft 7 of the band spool 8 is now coupled with the merely schematically illustrated drive or drive means 18, 28 and 29. This drive comprises a bevel or angular gearing 28 or equivalent gearing structure coupled with the drive motor 18, this bevel gearing 28 being drivingly connected with the shaft 7 by means of a disconnectable coupling or clutch 29. By means of this only schematically illustrated coupling 29 the coupling means 52 at the shaft 7 are connected with appropriate coupling means which can be driven by means of the bevel gearing 28.

The here not particularly illustrated friction or jaw brake 12 or 13, as the case may be, effective upon the winding band 9 or the band spool 8, respectively, is vented whereas the likewise not particularly illustrated friction or jaw brake 5, the braking force of which can be regulated in accordance with the decreasing package diameter, slightly brakes the shaft 3 of the winding core 4.

By means of the drive motor 18 the band spool 8 is driven in the direction of the arrow D, resulting in a winding-off of the winding band or tape 9 from the winding core 4 and a winding-up thereof upon the band spool 8. Owing to the braking of the shaft 3 the winding band 9 is unwound with an essentially constant tension or traction force. By means of the winding band 9 there is also unwound the imbricated product formation S' from the package rotating in the direction of the arrow E and such is outfed by means of the rocker member 22 and the band or belt conveyors 17 and 20 in the direction of the arrow F. In FIG. 4 there has been illustrated the final phase of the winding-off operation which, as previously mentioned, has been explained fully in the aforementioned co-pending U.S. Pat. No. 4,438,618 and the likewise cognate German Patent Publication No. 3,123,888 and the British Patent Publication No. 2,081,230.

In FIG. 5 there have been illustrated two product winding-up and storage devices 1 and 1' which are each provided with a respective product package 30 and 30', and which are stored in an intermediate storage. As recognized from FIG. 5, it is possible to store in abutting relationship both of the devices 1 and 1' together with the two packages 30 and 30', which beneficially reduces to a minimum the space requirements. This placement of the devices 1 and 1' in adjacent tandem relationship is possible because each band spool 8 is arranged beneath the related winding core 4 and the packages 30 and 30' located thereupon, and thus, during the alignment of the filled devices 1, 1' comes to lie in a space formed below the wound packages 30, 30', as shown.

By virtue of the aforementioned arrangement of the band spool 8 it is also possible to store the empty winding and storage devices 1, 1',1'' and so forth with a minimum space requirement, as such will be apparent from the illustration of FIG. 6. During the alignment and adjacent positioning of the frames 2 the band spool 8 of one device, such as the device 1 or 1', comes to lie in each case beneath the winding core 4 of the neighboring device such as the device 1' or 1'', as shown.

The frame 2 also can be equipped with rolls or casters which render possible a convenient manual displacement of the devices 1.

Since the winding band 9 continuously remains connected with the related winding core 4 and the band spool 8, an empty winding-up and storage device is ready at all times for winding-up printed products, without there having to be previously manually connected the winding band 9 with the winding core 4. The winding-up or winding-off operation can be interrupted at any point in time, without having to rewind or sever the winding band.

Since there can be stored upon the band spool 8 a sufficiently large winding band or tape supply, it is possible to form without any difficulty upon the winding core 4 wound packages having different requirements as concerns the length of the winding band or tape. Among other things, this means that for a given package diameter there can be readily wound-up printed products 21 of different thickness.

It should be understood that the winding-up and storage device 1 as well as also the delivery device 15 and removal device 27 can be constructed differently than heretofore described. Thus, for instance, it is possible to use in lieu of the jaw brakes 5, 12 and 13 also different types of friction brakes, for instance band brakes. With the described exemplary embodiments these jaw brakes 5, 12 and 13 serve both for respectively braking the shaft 3, the band 9 and the shaft 7 during the winding-up and winding-off operations as well as also for respectively blocking the winding core 4, the band 9 and the band spool 8. It should be understood that the braking and blocking action also can be accomplished by separate devices. The blocking devices are always arranged in the frame 2, whereas the braking arrangements for the winding core 4 and/or the band spool 8 or the guide roll 11, as the case may be, likewise are provided in the frame 2 or independent thereof at the winding-up station 14 or winding-off station 26. In the last-mentioned case there must be provided at the winding core 4 or at its shaft 3, at the winding spool 8 or its shaft 7 or at the guide roll 11, respectively, coupling means for the connection and disconnection of such brake arrangements provided at these stations 14 and 26.

As already explained, the brakes 5 and 13 must only be effective in the respective rotational direction E and B of the winding core 4 and the band spool 8, and the brake 12 only must be effective in the winding-up direction G of the winding band 9 upon the winding core 4. For this reason it is also conceivable to use for this purpose such type of brakes, for instance those having a free-wheeling action which, without having to be vented, are not effective in the rotational direction A and D of the winding core 4 and the winding band 8, respectively, or during the winding-up of the winding band upon the winding spool 8. Under certain circumstances it is possible to dispense with the described regulation of the braking force during the winding-off of the imbricated product stream or formation S from the winding core 4 and the winding band 9 from the band spool 8, respectively.

Finally, it is to be mentioned that it is possible to wind and store, in the described manner, also flat products other than printed products and which arrive in an imbricated product formation or stream.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for the storage of flat products, especially printed products, arriving in an imbricated product formation, comprising:

a rotatably mounted and driveable winding core to which there are infed from below the products which are conveyed towards the winding core;

at least one rotatable supply spool for a separation band traveling beneath a predetermined path of travel of the products;

said separation band being connected at one end with the winding core and during the winding-up of the products being fed from below to the winding core and being subjected to a tensional load;

a common mobile frame means in which there are mounted both said winding core and said supply spool;

a coupling arrangement for the selective coupling of drive means to one of said winding core and said supply spool;

a blocking device effective in a winding-off rotational direction of the products from the winding core; and said winding core being brakeable in the winding-off rotational direction.

2. The apparatus as defined in claim 1, further including:

a braking arrangement arranged in said frame means and effective in the winding-off rotational direction of the winding core for braking said winding core during winding-off of the products.

3. The apparatus as defined in claim 2, wherein:

said braking arrangement possesses a regulatable braking force for braking the winding core during the winding-off of the printed products.

4. The apparatus as defined in claim 2, wherein:

said blocking device is also constructed as said braking arrangement.

5. The apparatus as defined in claim 1, further including:

a brake arrangement independent of said frame means and with which there can be coupled the winding core for braking thereof during the winding-off of the products.

6. The apparatus as defined in claim 5, wherein:

said independent brake arrangement possesses a regulatable braking force.

7. The apparatus as defined in claim 1, further including:

a blocking device provided for the supply spool; and said blocking device for the supply spool being arranged in the frame means and being effective in a winding-off rotational direction of the supply spool.

8. The apparatus as defined in claim 1, further including:

a brake arrangement for braking the supply spool during the winding-off of the separation band; and said brake arrangement for braking the supply spool being arranged in the frame means and being effective in a winding-off rotational direction of the supply spool.

9. The apparatus as defined in claim 8, further including:

a blocking device provided for the supply spool;

said blocking device for the supply spool being arranged in the frame means and being effective in a winding-off rotational direction of the supply spool; and said blocking device also being constructed as the brake arrangement for braking the supply spool.

10. The apparatus as defined in claim 1, further including:

a brake arrangement independent of said frame means; and said brake arrangement being provided for said supply spool for braking thereof during the winding-off of the separation band.

11. The apparatus as defined in claim 10, wherein:

said brake arrangement for the supply spool has a regulatable braking force.

12. The apparatus as defined in claim 1, further including:

a blocking device arranged at the frame means and acting upon the separation band.

13. The apparatus as defined in claim 1, further including:

a brake arrangement which is effective upon the separation band during winding of the separation band upon the winding core.

14. The apparatus as defined in claim 13, wherein:

said brake arrangement effective upon the separation band is arranged at said frame means.

15. The apparatus as defined in claim 13, wherein:

said brake arrangement which is effective upon said separation band possesses a regulatable braking force.

16. The apparatus as defined in claim 13, further including:

a blocking device arranged at said frame means and effective upon said separation band; and said blocking device also being constructed as said brake arrangement.

17. The apparatus as defined in claim 16, further including:

at least one guide roll over which there is guided said separation band; and said brake arrangement being effective upon the separation band traveling over the guide roll or upon said guide roll.

18. The apparatus as defined in claim 1, wherein:

said blocking device comprises friction brake means.

* * * * *